US010340079B2

(12) United States Patent
Wan et al.

(10) Patent No.: US 10,340,079 B2
(45) Date of Patent: Jul. 2, 2019

(54) CURRENT TRANSFORMER

(71) Applicants: SEARI ELECTRIC TECHNOLOGY CO., LTD., Shanghai (CN); ZHEJIANG CHINT ELECTRICS CO., LTD., Yueqing (CN)

(72) Inventors: Xiangjun Wan, Shanghai (CN); Beilu Su, Shanghai (CN); Jun Wang, Shanghai (CN); Zhengxin Chen, Shanghai (CN); Jing Feng, Shanghai (CN)

(73) Assignees: SEARI ELECTRIC TECHNOLOGY CO., LTD., Shanghai (CN); ZHEJIANG CHINT ELECTRICS CO., LTD., Yueqing (CN)

( * ) Notice: Subject to any disclaimer, the term of this patent is extended or adjusted under 35 U.S.C. 154(b) by 70 days.

(21) Appl. No.: 15/502,054

(22) PCT Filed: Jul. 23, 2015

(86) PCT No.: PCT/CN2015/084896
§ 371 (c)(1),
(2) Date: Feb. 6, 2017

(87) PCT Pub. No.: WO2016/019806
PCT Pub. Date: Feb. 11, 2016

(65) Prior Publication Data

US 2017/0229236 A1 Aug. 10, 2017

(30) Foreign Application Priority Data

Aug. 6, 2014 (CN) ..... 2014 1 0383710

(51) Int. Cl.
*H01F 27/29* (2006.01)
*H01F 38/20* (2006.01)
(Continued)

(52) U.S. Cl.
CPC ..... *H01F 38/20* (2013.01); *H01F 3/10* (2013.01); *H01F 27/245* (2013.01);
(Continued)

(58) Field of Classification Search
USPC ..... 336/192, 175, 173, 174, 212
See application file for complete search history.

(56) References Cited

U.S. PATENT DOCUMENTS

2002/0130752 A1* 9/2002 Kuroshima ..... H01F 17/043 336/200
2005/0141159 A1* 6/2005 Gamba ..... H01F 38/30 361/93.1
(Continued)

FOREIGN PATENT DOCUMENTS

CN 2103195 U 4/1992
CN 1129347 A 8/1996
(Continued)

OTHER PUBLICATIONS

International Search Report issued in PCT/CN2015/084896, dated Oct. 29, 2015 (2 pages).
(Continued)

*Primary Examiner* — Elvin G Enad
*Assistant Examiner* — Kazi S Hossain
(74) *Attorney, Agent, or Firm* — Osha Liang LLP

(57) ABSTRACT

A current transformer includes a closed magnetic circuit and a secondary winding. A first part of the closed magnetic circuit completely surrounds a primary conductor, and a second part of the closed magnetic circuit forms the secondary winding. The second part of the closed magnetic circuit serves as a magnetic core of the secondary winding. The closed magnetic circuit forms a plurality of branch magnetic circuits at the second part, and a secondary winding is formed on each branch magnetic circuit. Each branch
(Continued)

magnetic circuit serves as a magnetic core of a corresponding secondary winding. Each secondary winding is staggered with each other in at least one of the length, the height and the thickness.

9 Claims, 5 Drawing Sheets

(51) Int. Cl.

| | |
|---|---|
| ***H01F 38/28*** | (2006.01) |
| ***H01F 27/245*** | (2006.01) |
| ***H01F 27/28*** | (2006.01) |
| ***H01F 27/32*** | (2006.01) |
| ***H01F 3/10*** | (2006.01) |
| ***H01F 38/30*** | (2006.01) |
| *H01F 30/04* | (2006.01) |

(52) U.S. Cl.
CPC ..... *H01F 27/2828* (2013.01); *H01F 27/324* (2013.01); *H01F 38/28* (2013.01); *H01F 38/30* (2013.01); *H01F 30/04* (2013.01)

(56) References Cited

U.S. PATENT DOCUMENTS

2005/0248350 A1* 11/2005 Tsuda ..... G01R 33/3815 324/322
2006/0255747 A1* 11/2006 Ichikawa ..... H05B 41/042 315/209 R
2011/0128111 A1* 6/2011 Roozeboom ..... H01F 17/0006 336/84 R
2011/0285210 A1* 11/2011 Lemmens ..... H02J 5/005 307/104
2013/0285786 A1* 10/2013 Hu ..... H01F 3/12 336/220
2014/0140485 A1* 5/2014 Wang ..... H05G 1/12 378/101

FOREIGN PATENT DOCUMENTS

| | | | |
|---|---|---|---|
| CN | 1499542 | A | 5/2004 |
| CN | 1637968 | A | 7/2005 |
| CN | 1314057 | C | 5/2007 |
| CN | 101552119 | A | 10/2009 |
| CN | 101206951 | B | 8/2010 |
| CN | 101908413 | A | 12/2010 |
| CN | 101313375 | B | 4/2011 |
| CN | 102800471 | A | 11/2012 |
| CN | 101685725 | B | 12/2012 |
| CN | 202905388 | U | 4/2013 |
| CN | 103635979 | A | 3/2014 |

OTHER PUBLICATIONS

Written Opinion of the International Searching Authority issued in PCT/CN2015/084896, dated Oct. 29, 2015 (3 pages).
Office Action issued in corresponding Chinese Application No. 201410383710.7 dated Sep. 29, 2016 (9 pages).
Office Action issued in Chinese Application No. 201410383710.7; dated Apr. 6, 2017 (8 pages).

* cited by examiner

Prior Art

CURRENT TRANSFORMER

BACKGROUND OF THE INVENTION

1. Field of the Invention

The invention relates to a technical field of low-voltage electrical apparatus, more particularly, relates to a current transformer used for supplying power to an electronic release.

2. The Related Art

In a power distribution system, a circuit breaker performs functions of connecting, breaking or carrying a rated operation current, the circuit breaker further performs a function of protecting fault currents such as a short circuit current or an overload current. When a short circuit occurs in a circuit, the circuit breaker can automatically cut off the circuit under the premise of not using an external power supply so that a reliable protection is achieved. A breaking device in the circuit breaker is used for realizing a breaking action. A current transformer supplies power to the breaking device. The power of the current transformer comes from a current flowing through a primary conductor of the circuit breaker, that is, a primary current.

FIG. 1 illustrates a structural diagram of a current transformer according to prior art. As shown in FIG. 1, the current transformer comprises a closed magnetic circuit 101. The closed magnetic circuit 101 includes laminated or wound soft magnetic metal sheets, riveting pieces 102 connect the soft magnetic metal sheets to form the closed magnetic circuit 101. The closed magnetic circuit 101 completely surrounds a primary conductor 107. For the purpose of match the shape of the primary conductor 107, a first part of the closed magnetic circuit 101 (the upper part shown in FIG. 1) is designed to have a corresponding shape. As shown in FIG. 1, the first part of the closed magnetic circuit 101 is arc-shaped to accommodate a circular primary conductor 107. A second part of the closed magnetic circuit 101 (the lower part shown in FIG. 1) serves as a magnetic core of a secondary winding 113. FIG. 2 illustrates a structural diagram of a secondary winding of a current transformer according to prior art. As shown in FIG. 2, a main structure of the secondary winding is an insulating framework 204. The insulating framework 204 is hollow to form a cavity 203. The second part of the closed magnetic circuit 101 passes through the cavity 203 (see FIG. 1). The insulating framework 204 is wound with a wire 205, and the wire 205 forms a coil. The number of turns of the coil may be set according to requirements. The wire 205 is covered by an insulating layer 201. The wire 205 leads two leads 206 extending out of the insulating layer 201. The leads 206 shown in FIG. 2 are the leads 115 on the secondary winding 113 shown in FIG. 1. Sheet-shaped structures 202 are formed on both ends of the insulating framework 204, and the sheet-shaped structure 202 isolates the magnetic circuit and the wire. As shown in the figure, the sheet-shaped structure 202 is extended outwardly from the insulating framework 204, the sheet-shaped structure 202 has a larger cross-sectional area than the insulating framework 204. A current transformer with such a structure has a good linear output characteristic when a primary current does not reach a large level of saturation of the magnetic material. When the primary current increases, a secondary current also increases in proportion so as to meet the requirements of power supply energy for the circuit breaker protection device.

Existing universal circuit breakers generally adopt a built-in structure, volume becomes a major factor that affects the performance of a current transformer. Due to the limitation of volume, the size of the current transformer cannot be increased infinitely. For small-shell circuit breakers, because of a small size of a small-shell circuit breaker, a shell of a current transformer therein is also small. Then a magnetic circuit volume of the current transformer and the number of turns of a coil on a secondary winding are limited. Under the condition that the number of turns of the coil is limited, the output energy of the secondary winding coil is small. The circuit breaker cannot achieve an automatic cut off of the circuit without the help of an external power supply under a condition when a short circuit transient current is small multiple of a minimum rated current of the circuit breaker (generally 2In~3In). A tripping device is required to be driven by an energy outputted by the current transformer under a large multiple of the rated current. The application of the current transformer is thus limited.

SUMMARY

The present invention provides a new current transformer, more secondary windings are provided within a same volume such that the output energy of the secondary windings increases.

According to an embodiment, a current transformer is provided. The current transformer comprises:

a closed magnetic circuit, a first part of the closed magnetic circuit completely surrounds a primary conductor;

a second part of the closed magnetic circuit forms a secondary winding, the second part of the closed magnetic circuit serves as a magnetic core of the secondary winding;

the closed magnetic circuit forms a plurality of branch magnetic circuits at the second part, and a secondary winding is formed on each branch magnetic circuit, each branch magnetic circuit serves as a magnetic core of a corresponding secondary winding, each secondary winding is staggered with each other in at least one of the length, the height and the thickness.

According to an embodiment, the branch magnetic circuits formed by the second part of the closed magnetic circuit are mutually staggered in the length and the height, each branch magnetic circuit forms a closed magnetic circuit with the first part, wherein one branch magnetic circuit and the first part forms a closed primary magnetic circuit, and the rest branch magnetic circuits and the first part form closed auxiliary magnetic circuits.

According to an embodiment, a total height of the plurality of branch magnetic circuits of the second part of the closed magnetic circuit in the height is equal to a height of the first part of the closed magnetic circuit.

According to an embodiment, each secondary winding comprises:

an insulation framework, the insulation framework is hollow to form a cavity, one branch magnetic circuit passes through the cavity to form a magnetic core of the secondary winding;

a wire is wound on the insulating framework, the wire is wrapped by an insulating layer, a wire of each secondary winding leads out two leads extending outside of the insulating layer;

sheet-shaped structures being formed on both ends of the insulating framework, and the sheet-shaped structure isolates the magnetic circuit and the wire.

According to an embodiment, the insulating frameworks of the secondary windings have different lengths, the sheet-shaped structures at the two ends of each insulation framework are mutually staggered in thickness.

According to an embodiment, the closed magnetic circuit is formed with soft magnetic metal sheets, a first part of the closed magnetic circuit is arc-shaped and surrounds a circular primary conductor; or a first part of the closed magnetic circuit is square and surrounds a square-shaped primary conductor.

According to an embodiment, the plurality of secondary windings are connected in series by respective leads.

According to an embodiment, the plurality of secondary windings are connected in parallel by respective leads.

According to an embodiment, the plurality of secondary windings have different sizes and different numbers of turns.

According to an embodiment, the plurality of secondary windings have a same size and a same number of turns.

The current transformer of the present invention fully utilizes the idle space therein. A plurality of secondary windings are arranged in a spatial interleaving manner and a plurality of secondary windings are arranged in a spatial interleaving manner, the plurality of secondary windings significantly increase a total energy outputted by the circuit transformer. Larger output energy is obtained under a same volume, and a performance of the circuit breaker under a small current condition can be improved.

BRIEF DESCRIPTION OF THE DRAWINGS

The above and other features, natures, and advantages of the invention will be apparent by the following description of the embodiments incorporating the drawings, wherein.

DETAILED DESCRIPTION OF EMBODIMENTS

The energy outputted by a current transformer is dependent on the number of turns of a coil included in the current transformer and the diameter of the coil. Under a same primary current, the more the number of turns of the coil is, and the larger the diameter of the coil is, the larger the energy outputted by the current transformer is. A typical method for increasing the number of turns and the diameter of the coil is enlarging a volume of the secondary winding. If a size of an insulation framework of the secondary winding is enlarged, more turns of wires can be wound on the insulation framework, which may increase the number of turns of the coil and the diameter of the coil. However, when the size of the insulation framework increases, an overall volume of the current transformer will increase and a volume of a circuit breaker increases accordingly.

Figure 1:
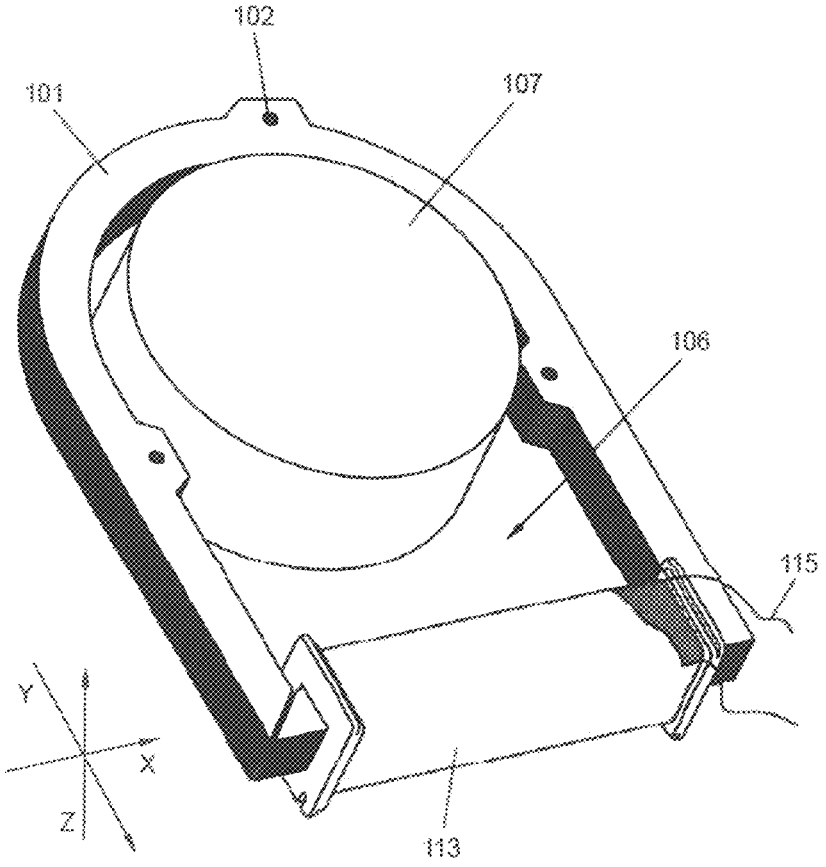
FIG. 1 illustrates a structural diagram of a current transformer according to prior art.

Continue with FIG. 1, three directions are defined in FIG. 1 and represented by X, Y and Z respectively. The X, Y and Z directions are perpendicular to each other. The X direction indicates a thickness direction, the Y direction indicates a length direction, and the Z direction indicates a height direction. The size of the current transformer is mainly dependent on a size of the primary conductor and a length of the insulating framework in the X direction, mainly dependent on a length of the closed magnetic circuit on the Y direction and mainly dependent on a height of the closed magnetic circuit and a size of the sheet-shaped structure at both ends of the insulated framework on the Z direction. Therefore, if it is desirable to increase the number of turns and the diameter of the coil, the length of the insulating framework needs to be increased, and the insulating framework is made to have a larger diameter. The increase of the diameter of the insulating framework also increases the diameter of the sheet-shaped structure. Thus, the size of the current transformer in both the X direction and the Z direction increases. The increase in size of the current transformer does not meet the development trend of a modern circuit breaker. Modern circuit breakers are required to be miniaturized so that the design scheme with increased volume cannot be accepted.

Increase of the number of turns of the coil can also be realized by increasing the number of secondary windings. The purpose of increasing the number of turns of the coil can be achieved by arranging a plurality of secondary windings. When the number of turns of the coil is increased, it is not necessary to further considering the change of the diameter of the coil. Increase of the number of turns of the coil can obviously improve the output energy of the current transformer under a same primary current. As shown in FIG. 1, in an existing current transformer, there is a space 106 between the primary conductor 107 and the secondary winding 113, the space 106 is not utilized and is idle.

The present invention uses the space 106 described above to arrange a plurality of secondary windings. The closed magnetic circuit is made of stacked or wound soft magnetic metal sheets, and the soft magnetic metal sheets can be flexibly split or bent according to actual requirements. Such modifications are all within an original external contour space of the current transformer. All modifications utilize internal idle spaces and do not change a size of the current transformer.

Figure 3:
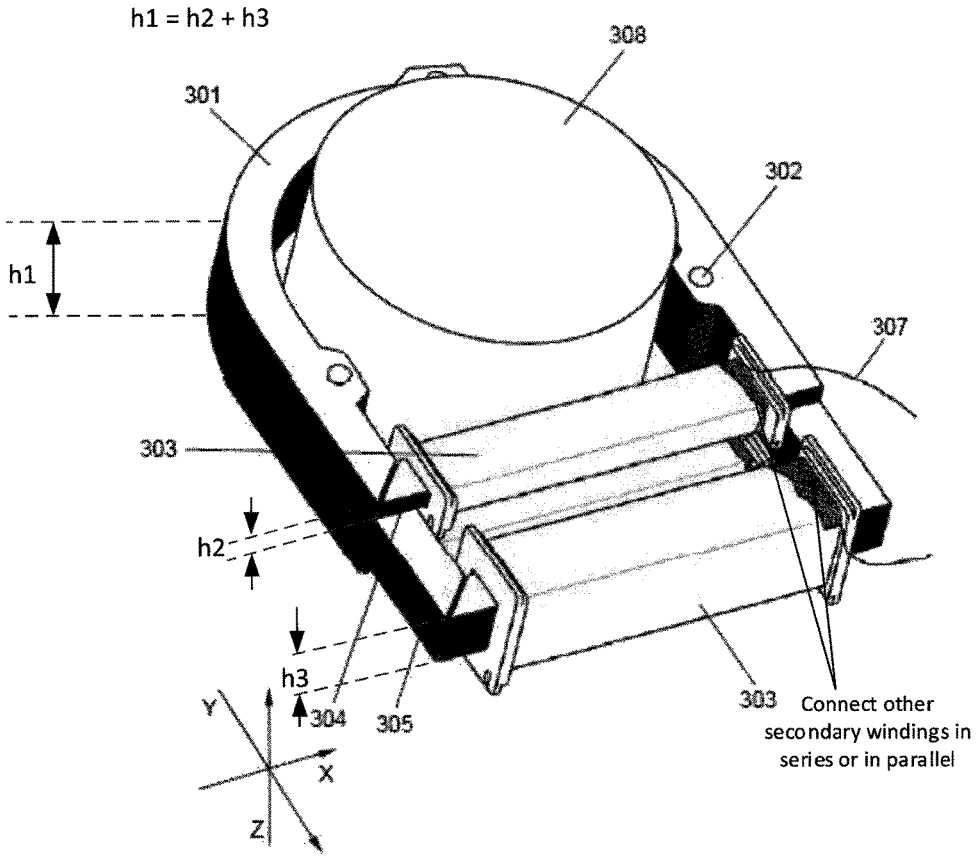
FIG. 3 illustrates a structural diagram of a current transformer according to an embodiment of the present invention.

FIG. 3 illustrates a structural diagram of a current transformer according to an embodiment of the present invention. As shown in FIG. 3, the current transformer comprises a closed magnetic circuit 301 and a plurality of secondary windings 303.

A first part of the closed magnetic circuit 301 completely surrounds a primary conductor 308. The first part is the upper part shown in FIG. 3. A second part of the closed magnetic circuit 301 forms a secondary winding. The second part of the closed magnetic circuit serves as a magnetic core of the secondary winding. The second part is the lower part shown in FIG. 3.

The closed magnetic circuit 301 forms a plurality of branch magnetic circuits 304, 305 at the second part. One secondary winding 303 is formed on each branch magnetic circuit. Each branch magnetic circuit serves as a magnetic core of a corresponding secondary winding. Each secondary winding 303 is staggered with each other in at least one of the length, the height and the thickness.

Each branch magnetic circuit is formed by splitting of laminated or wound soft magnetic metal sheets. Generally, the respective branch magnetic circuits are bent at different positions in Y direction, so that the branch magnetic circuits are staggered in Y direction (i.e., the length direction). Meanwhile, the respective branch magnetic circuits are formed by different layers of soft magnetic metal sheets and they are naturally staggered in Z direction (i.e., the height direction). Because the branch magnetic circuits are formed by splitting of laminated or wound soft magnetic metal sheets, a total height of the plurality of branch magnetic circuits in the height direction is equal to a height of the first part of the closed magnetic circuit.

Figure 2:
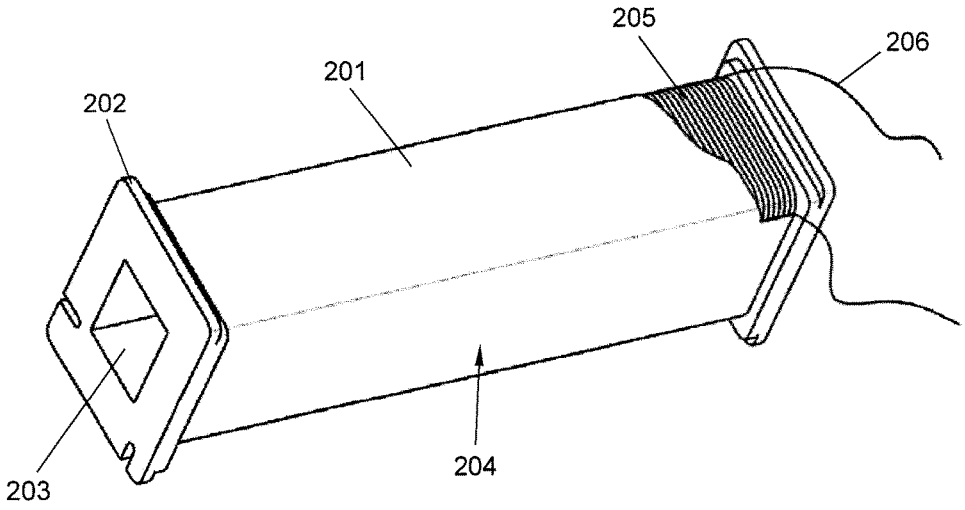
FIG. 2 illustrates a structural diagram of a secondary winding of a current transformer.

Each secondary winding 303 has a structure similar to that shown in FIG. 2, comprising: an insulation framework 204, a wire 205, an insulating layer 201, leads 206 and sheet-shaped structures 202. The insulation framework 204 is hollow to form a cavity 203. One branch magnetic circuit passes through the cavity 203 to form a magnetic core of the secondary winding. The wire 205 winds on the insulating framework 204, the wire 205 is wrapped by the insulating layer 201. The wire 205 of each secondary winding leads out two leads 206 extending outside of the insulating layer. The leads 206 are denoted as leads 307 in FIG. 3. The sheet-shaped structures 202 are formed on both ends of the insulating framework 204, and the sheet-shaped structure 202 isolates the magnetic circuit and the wire.

In each secondary winding 303, the most outwardly protruding portion of an outer contour is the sheet-shaped structure 202. In order to avoid mutual interference between the secondary windings 303, it is also necessary to consider the position between the sheet-shaped structures 202. In some embodiments, by arranging the respective branch magnetic circuits in a staggered manner in Y direction and Z direction, the sheet-shaped structures 202 at both ends of the insulating framework 204 of respective secondary windings 303 do not interfere with each other. In other embodiments, if a size of the sheet-shaped structure 202 is large, only a staggered arrangement of the respective branch magnetic circuits in Y direction and Z direction is not sufficient to separate the sheet-shaped structures 202 of respective secondary windings 303 from each other. At this time, a further adjustment may be achieved in X direction (the thickness direction). For example, the insulating framework 204 of respective secondary windings may have different lengths. Thus, the sheet-shaped structures 202 at both ends of respective insulating frameworks are further staggered in the thickness direction and will not interfere with each other.

The plurality of secondary windings in the current transformer of the present invention are staggered in at least on direction of length, height and thickness (the X direction, Y direction or Z direction), so that the plurality of secondary windings can be placed in the current transformer without influence each other. Here, a staggered manner of respective secondary windings in at least one direction of lengths, height or thickness (the X direction, Y direction or Z direction) includes staggering in on direction, staggering in two directions or staggering in all three directions.

Continue with FIG. 3, each of the plurality of branch magnetic circuits 304, 305 formed by the second part of the closed magnetic circuit 301 forms a closed magnetic circuit with the first part. One branch magnetic circuit and the first part forms a closed primary magnetic circuit, and the rest branch magnetic circuits and the first part form closed auxiliary magnetic circuits. According to the embodiment shown in FIG. 3, the branch magnetic circuit 305 is the primary magnetic circuit and the branch magnetic circuit 304 is the auxiliary magnetic circuit. Generally, the primary magnetic circuit 305 has more soft magnetic metal sheets that the auxiliary magnetic circuit 304, thus the primary magnetic circuit 305 looks thicker than the auxiliary magnetic circuit 304. The positions of the primary magnetic circuit and the auxiliary magnetic circuit are not limited. The primary magnetic circuit may be arranged on the outer side (away from the primary conductor), and the auxiliary magnetic circuit may be arranged on the inner side (between the primary conductor and the primary magnetic circuit). Or the primary magnetic circuit may be arranged on the inner side and between the primary conductor and the auxiliary magnetic circuit. Or a part of the auxiliary magnetic circuit may be arranged on the inner side of the primary magnetic circuit and the other part of the auxiliary magnetic circuit may be arranged on the outer side of the primary magnetic circuit.

According to the embodiment shown in FIG. 3, the stacked or wound soft magnetic metal sheets are connected together by a riveting element 302. The riveting element 302 may be provided in the first part of the closed magnetic circuit so as to fix all of the soft magnetic metal sheets. Or the riveting element 302 may provided in the second part of the closed magnetic circuit so as to fix the soft magnetic metal sheets in a particular branch magnetic circuit.

Each secondary winding 303 has a respective lead 307, and each secondary winding 303 leads out two leads 307. The respective secondary windings 303 in the current transformer may be connected in parallel, or be connected in series. The parallel or series connection of the secondary windings is achieved through respective leads. Finally, two leads are led out from the current transformer to serve as the leads of the current transformer.

The respective secondary windings 303 may have different sizes and different numbers of turns. For example, the respective secondary windings may have different diameters and lengths according to actual space of placement. Different diameters and lengths result differences in size and number of turns. Or, if the space of placement is sufficient, the respective secondary windings may have a same size and a same number of turns.

Figure 4:
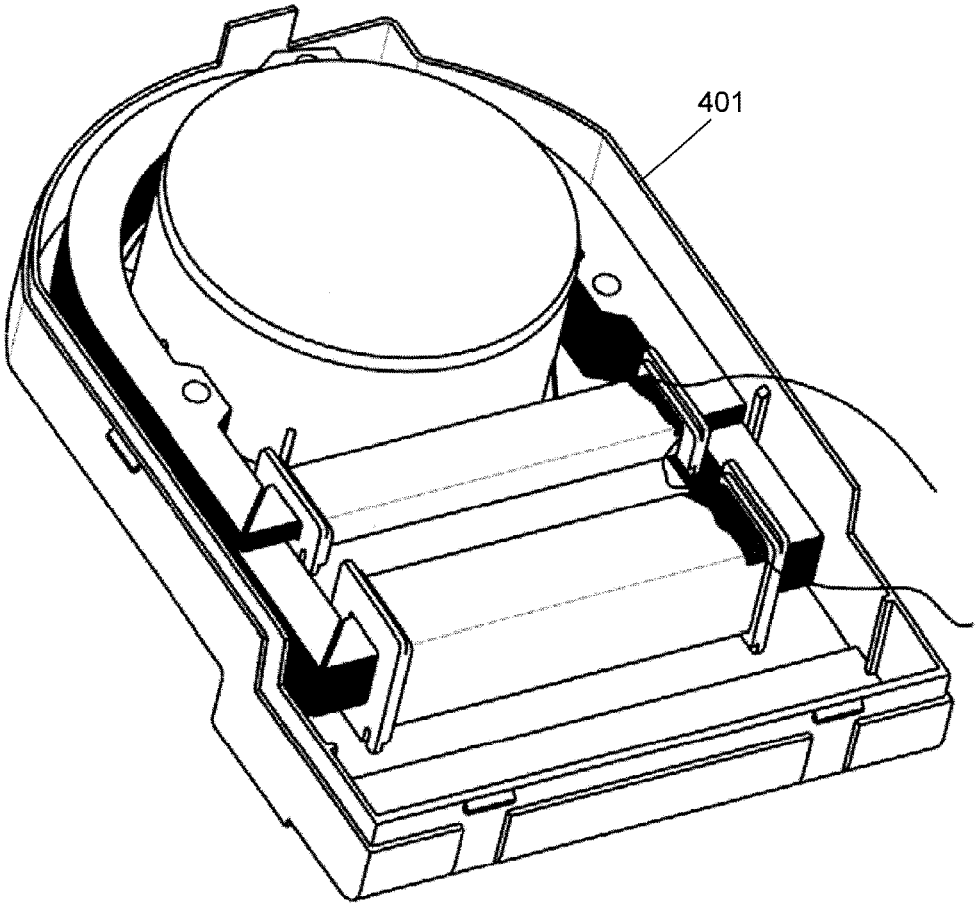
FIG. 4 illustrates a structural diagram of a current transformer and a transformer housing according to an embodiment of the present invention.

FIG. 4 illustrates a structural diagram of a current transformer and a transformer housing according to an embodiment of the present invention. The current transformer is placed in a housing 401. According to the present invention, the additional secondary windings in the current transformer utilize idle spaces within the current transformer, thus a size of the outer contour of the current transformer does not increase, the volume does not change as well. Therefore, it is not necessary to change the size of the housing 401.

According to the embodiment shown in FIG. 3, the first part of the closed magnetic circuit 301 is arc-shaped and surrounds a circular primary conductor 308.

Figure 5:
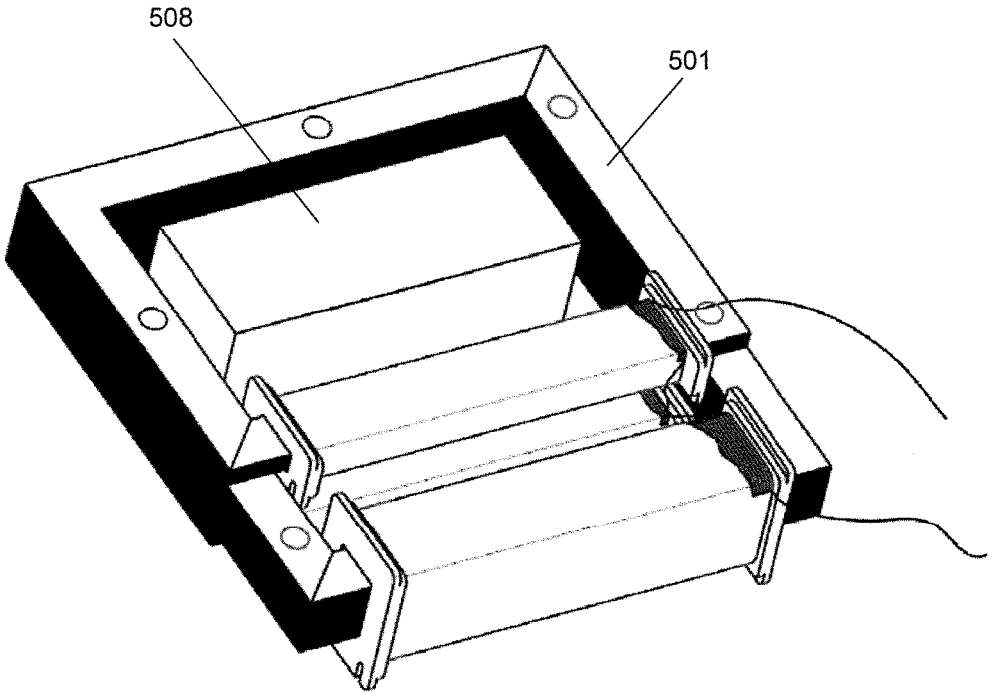
FIG. 5 illustrates a structural diagram of a current transformer according to another embodiment of the present invention.

FIG. 5 illustrates a structural diagram of a current transformer according to another embodiment of the present invention. Compared with the embodiment shown in FIG. 3, the embodiment shown in FIG. 5 differs in that the first part of the closed magnetic circuit 501 is square and surrounds a square-shaped primary conductor 508. Other structures of this embodiment are similar to that of the embodiment shown in FIG. 3.

The current transformer of the present invention fully utilizes the idle space therein. A plurality of secondary windings are arranged in a spatial interleaving manner and a plurality of secondary windings are arranged in a spatial interleaving manner, the plurality of secondary windings significantly increase a total energy outputted by the circuit transformer. Larger output energy is obtained under a same volume, and a performance of the circuit breaker under a small current condition can be improved.

The above embodiments are provided to those skilled in the art to realize or use the invention, under the condition that various modifications or changes being made by those skilled in the art without departing the spirit and principle of the invention, the above embodiments may be modified and changed variously, therefore the protection scope of the invention is not limited by the above embodiments, rather, it should conform to the maximum scope of the innovative features mentioned in the Claims.

What is claimed is:

1. A current transformer comprising:

a closed magnetic circuit, a first part of the closed magnetic circuit completely surrounding a primary conductor;

a second part of the closed magnetic circuit forming one or more secondary windings, the second part of the closed magnetic circuit serving as a magnetic core of the one or more secondary windings;

wherein, the closed magnetic circuit forms a plurality of branch magnetic circuits at the second part, and one secondary winding is formed on each branch magnetic circuit, each branch magnetic circuit serves as the magnetic core of the corresponding secondary winding, each secondary winding is staggered with each other in at least one of a length direction, a height direction, and a thickness direction;

the plurality of branch magnetic circuits formed at the second part of the closed magnetic circuit are mutually staggered in the length direction and the height direction, and each branch magnetic circuit forms the closed magnetic circuit with the first part; and wherein, in the height direction, a sum of heights of the plurality of branch magnetic circuits is equal to a height of the first part of the closed magnetic circuit.

2. The current transformer according to claim 1, wherein one branch magnetic circuit and the first part forms a closed primary magnetic circuit, and the rest of the branch magnetic circuits and the first part form closed auxiliary magnetic circuits.

3. The current transformer according to claim 2, wherein each secondary winding comprises:

an insulation framework, the insulation framework being hollow to form a cavity, one branch magnetic circuit passing through the cavity to form the magnetic core of the secondary winding;

a wire wound on the insulating framework, the wire being wrapped by an insulating layer, a wire of each secondary winding leading out two leads extending outside of the insulating layer;

sheet-shaped structures being formed on both ends of the insulating framework, and the sheet-shaped structures isolating the magnetic circuit and the wire.

4. The current transformer according to claim 3, wherein the insulating frameworks of the one or more secondary windings have different lengths, the sheet-shaped structures at the two ends of each insulation framework are mutually staggered in the thickness direction.

5. The current transformer according to claim 4, wherein the closed magnetic circuit is formed with soft magnetic metal sheets, the first part of the closed magnetic circuit is arc-shaped and surrounds a circular primary conductor; or the first part of the closed magnetic circuit is square and surrounds a square-shaped primary conductor.

6. The current transformer according to claim 3, wherein the one or more secondary windings are connected in series by respective leads.

7. The current transformer according to claim 3, wherein the one or more secondary windings are connected in parallel by respective leads.

8. The current transformer according to claim 3, wherein the one or more secondary windings have different sizes and different numbers of turns.

9. The current transformer according to claim 3, wherein the one or more secondary windings have a same size and a same number of turns.

* * * * *